US005585028A

United States Patent [19]

Berger

[11] Patent Number: 5,585,028

[45] Date of Patent: Dec. 17, 1996

[54] FIRE FIGHTING AND COOLING COMPOSITION

[75] Inventor: Paul H. Berger, Rome, N.Y.

[73] Assignees: Robert E. Tyler; Robert E. Tinsley, Jr.; W. Michael Hagar; Welsey Wright; Gentry R. P. Ferrell, all of Lynchburg, Va.

[21] Appl. No.: 547,991

[22] Filed: Oct. 25, 1995

Related U.S. Application Data

[63] Continuation of Ser. No. 332,489, Oct. 31, 1994, abandoned, which is a continuation of Ser. No. 143,745, Nov. 1, 1993, abandoned.

[51] Int. Cl.[6] ..... A62D 1/02; A62D 1/04

[52] U.S. Cl. ..... 252/2; 252/3; 252/8.05; 252/601; 169/46

[58] Field of Search ..... 252/2, 3, 8.05, 252/601, 547, 550, 551; 169/46, 47

[56] References Cited

U.S. PATENT DOCUMENTS

| | | | |
|---|---|---|---|
| 3,772,195 | 11/1973 | Francen | 252/8.05 |
| 3,950,417 | 4/1976 | Verdicchio et al. | 252/545 |
| 4,099,574 | 7/1978 | Cooper et al. | 169/47 |
| 4,166,845 | 9/1979 | Hansen et al. | 424/78 |
| 4,375,421 | 3/1983 | Rubin et al. | 252/110 |
| 4,472,286 | 9/1984 | Falk | 252/3 |
| 4,479,893 | 10/1984 | Hirota et al. | 252/542 |
| 4,595,526 | 6/1986 | Lai | 252/545 |
| 4,681,704 | 7/1987 | Bernardino et al. | 252/546 |
| 4,753,754 | 6/1988 | Messenger et al. | 252/354 |
| 5,039,451 | 8/1991 | Phillips et al. | 252/356 |
| 5,061,383 | 10/1991 | Friloux et al. | 252/3 |
| 5,085,786 | 2/1992 | Alm et al. | 252/8.05 |
| 5,246,613 | 9/1993 | Gilbert et al. | 252/117 |
| 5,389,304 | 2/1995 | Repinec, Jr. et al. | 252/546 |

*Primary Examiner*—Sharon Gibson
*Assistant Examiner*—Joseph D. Anthony
*Attorney, Agent, or Firm*—Whitham, Curtis, Whitham & McGinn

[57] ABSTRACT

A fire fighting and cooling composition that is particularly useful for fighting fires involving polar solvents and volatile liquid hydrocarbons includes a combination of non-ionic surfactants, such as amine oxides, organic sulfates or sulfonates, and amphoteric surfactants, such as acylamidoalkylbetaines.

20 Claims, No Drawings

FIRE FIGHTING AND COOLING COMPOSITION

This is a continuation of application Ser. No. 08/332,489, filed Oct. 31, 1994 now abandoned, which was a continuation of application Ser. No. 08/143,745, filed Nov. 1, 1993, now abandoned.

BACKGROUND OF THE INVENTION

1. Field of the Invention

The present invention is generally related to a chemical composition designed and formulated for the safe suppression and control of fires involving liquid hydrocarbons and/or polar solvents.

2. Description of the Prior Art

Many fire fighting compositions have employed the mechanism of using a foam blanket to smother the fire and isolate the fuel from an oxygen source that will support combustion of the fuel. Many of them do not produce stable foams in the presence of extremely volatile liquid hydrocarbons and polar solvents. The most successful compositions have used fluorocarbon surfactants as a part of their surfactant group. The presence of the fluorocarbons gives an aqueous solution that will form a tough film to seal the hydrocarbon surface and stabilize the foam formation. Fluorocarbon surfactants are very chemically stable, making them invulnerable to many forms of degradation. Soil bacteria are not able to metabolize fluorocarbon surfactants. At test facilities where repeated use of these materials has occurred, fluorocarbon surfactants have descended through the soil without being degraded by the normal bacterial compliment, and have contaminated groundwater. Movement of the fluorocarbon surfactants through the groundwater has resulted in contamination of potable water supplies. Their long life has made their indiscriminate use an environmental threat.

Application of most foams, comprised of common surfactants, to volatile hydrocarbon and polar solvent surfaces will result in the rapid breakdown of the foam resulting in failure to extinguish and seal.

SUMMARY OF THE INVENTION

An object of this invention is to provide a fire fighting and cooling composition that is better suited for extinguishing fires involving liquid hydrocarbons and polar solvents.

Another object of this invention is to provide a fire fighting and cooling composition that is better suited for protectant/retardant applications and which can allow more water to adhere to three dimensional surfaces (homes, buildings, etc.).

According to the invention, a composition containing non-ionic surfactants, anionic surfactants, and amphoteric surfactants, and possibly salts or acids such as sodium chloride and citric acid is used in combination with conventional fire fighting equipment to provide a foam composition with a synergistic and superior fire extinguishing effect. In operation, a mixture layer is formed at the fuel surface which consists of a double concentration gradient with a high concentration of fuel, low concentration water and surfactant at the bottom and a high concentration of water and surfactant, low concentration of fuel at the top. A stable environment is created for the foam by emulsifying the hydrocarbons and mixing them with the hydrocarbon fuels or polar solvents. It is proposed that this gradient layer created by the surfactant blend of this invention will support a long foam life. The addition of various salts and acids to the composition can help facilitate stable foam formation.

DETAILED DESCRIPTION OF THE PREFERRED EMBODIMENTS OF THE INVENTION

It has been found that a fire fighting and cooling composition especially effective on hydrocarbon and polar solvent fires is formulated using a semi-polar non-ionic surfactant, an anionic surfactant, and an amphoteric surfactant. The fire fighting and cooling composition is sprayable using conventional fire fighting equipment such as that which is available from Akron Brass and other companies.

As used herein, all percentages, parts and ratios are by weight unless otherwise indicated. The surfactants used in the inventive composition include substituted or unsubstituted alkyl and aryl moieties. A typical substituted constituent would be a hydroxy molecule; however, other constituents which may be substituted on the alkyl and aryl moieties will be readily apparent to those skilled in the art.

The non-ionic surfactant used in the fire fighting and cooling composition is typically present at 0.25–10% by weight. The non-ionic surfactant should be semi-polar in character and be selected from the group consisting of water soluble amine oxides, phosphine oxides, and sulfoxides. Typically the amine oxides, phosphine oxides and sulfoxides will have one alkyl or hydroxyalkyl moiety of 8 to 28 carbon atoms. Additionally, one or two additional alkyl moieties will be joined to the amino, phosphorous, or sulfur group and these moieties will typically include 1–3 carbon atoms and may also be substituted with hydroxy groups. Mixtures of several different non-ionic surfactants can be advantageously employed in the fire fighting and cooling composition. Of the water soluble semi-polar non-ionic surfactants, the group most useful to this invention is the group composed of the water soluble amine oxides. Of this group, those having one alkyl or hydroxyalkyl moiety of 8 to 16 carbon atoms and two alkyl moieties selected from the group consisting of alkyl and hydroxyalkyl groups containing 1 to 3 carbon atoms are most preferred. Examples of this group include dimethyloctylamine oxide, diethyldecylamine oxide, bis-(2-hydroxyethyl) dodecylamine oxide, dimethyldodecylamine oxide, dipropyltetradecylamine oxide, and methylethylhexadecylamine oxide. Of the examples, dimethyldodecylamine oxide is the most preferred water soluble amine oxide.

The anionic surfactant used in the fire fighting and cooling composition is an organic sulfate or organic sulfonate, or mixtures thereof, and is typically present at concentrations of 10–50% by weight. The weight ratio of the semi-polar non-ionic surfactant to the anionic surfactant should range between 1:99 and 1:1. The anionic surfactant is preferably present as an alkaline earth metal salt and is selected from the group consisting of: (a) alkyl, alkyl benzene, alkyl glyceryl ether, and olefin sulfonates wherein the alkyl group contains 8–28 carbon atoms; (b) alkyl sulfates having the formula $(ROSO_3)_nM$ where R is a substituted or unsubstituted alkyl group having 8–28 carbon atoms and M is a divalent alkaline earth metal when n is 1 and M is a sodium, potassium, ammonium or substituted ammonium when n is 2; and (c) alkyl ether sulfates having the formula "$(RO(C_2H_4O)_\omega SO_3)_nM$" where R is a substituted or unsubstituted alkyl group having 8–28 carbon atoms, ω ranges from 1–30, and M is a divalent alkaline earth metal when n is 2 and M is a sodium, potassium, ammonium or substituted ammonium when n is 1. The most preferred examples of the anionic surfactants include:

(1) Alkyl benzene sulfonates in which the alkyl group contains from 9 to 15 carbon atoms, preferably 11 to 14 in a straight chain or branched chain configuration. Being more readily metabolized by micro-organisms, the straight chain configuration is preferred, with a 12 carbon alkyl being most preferred.

(2) Alkyl sulfates derived by sulfating an alcohol having 8 to 28 carbon atoms, preferably 12 to 16 carbon atoms. $(ROSO_3)_2M^1$ and $(ROSO_3)M^2$ are the formulas for the alkyl sulfates, where R is the $C_{8-22}$ alkyl group, $M^1$ is a divalent alkaline earth metal ($Mg^{++}$ and $Ca^{++}$), and $M^2$ is $Na^+$, $K^+$, or $NH_4^+$ or substituted ammonium (triethanol ammonium, diethanol ammonium, ethanol ammonium, etc.).

(3) Alkyl sulfonates having 8 to 28 carbon atoms, preferably 12 to 16 carbon atoms in the alkyl moiety.

(4) Olefin sulfonates having 8 to 28 carbon atoms, preferably 12 to 16 carbon atoms.

(5) Alkyl ether sulfates derived from ethoxylating an alcohol having 8 to 28 carbon atoms, preferably 12 to 16 carbon atoms with 1 to 30, preferably 1 to 12 moles of ethylene oxide and then sulfating. The resultant structure is not stable enough to be of a life suitable for commercial use unless it is immediatly reacted with base to form an alkaline earth metal, ammonium, or substituted ammonium salt. The alkyl ether sulfates useful to this invention have the formulas:

$$[RO(C_2H_4O)_\omega SO_3]_2M \text{ and } [RO(C_2H_4O)_\omega SO_3]M^1$$

where R is the $C_{8-28}$ alkyl group, ω is 1 to 30, M is a divalent alkaline earth metal ($Mg^{++}$and $Ca^{++}$), and $M^1$ is $Na^+$, $K^+$ or $NH_4^+$ or substituted ammonium.

(6) Alkyl glyceryl ether sulfonates having 8 to 28 carbon atoms, preferably 12 to 16 carbon atoms in the alkyl moiety; and (7) Mixtures of (1)–(6) can provide enhanced results.

(2) and/or (5) are preferred for use as the anionic surfactant.

The above-described anionic surfactants are commercially available in both the acid and neutralized forms. Those available as acids can be converted to the desired salt by direct neutralization with the appropriate base. Those available in a neutralized form can be used to develop a desired alkaline earth metal salt by ion exchange; especially useful for this purpose are the ammonium salts of the anionic surfactants. Magnesium hydroxide is the most preferable ion source for the exchange.

The amphoteric surfactants utilized preferably have an alkyl moiety of 8–28 carbon atoms, a positively charged amino group, and a negatively charged carboxylic acid group. Suitable amphoteric compounds have the following formula:

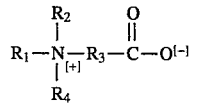

wherein $R_{1-4}$ are selected from the group consisting of substituted and unsubstituted alkyl constituents, substituted and unsubstituted cycloalyl constituents, substituted and unsubstituted aryl constituents, and ethoxylated hydroxy groups containing 1–10 ethylene oxide units, and may be the same or different. The amphoteric compounds preferably comprise 0.5%–15% of the composition and, most preferably 1–10% by weight of the composition. Particularly preferred amphoteric surfactants would be acylamidoalkylbetaines having the following formula:

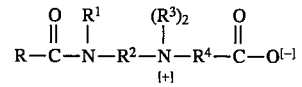

wherein R is a substituted or unsubstituted alkyl or alkylaryl group having 6–28 carbon atoms, and most preferably 9–12 carbon atoms, $R^1$ is a hydrogen or substituted or unsubstituted alkyl group having 1–6 carbon atoms, and most preferably 1–3 carbon atoms, $R^2$ is a substituted or unsubstituted alkylene group having 1–10 carbon atoms, and most preferably 2–6 carbon atoms, $R^3$ is a substituted or unsubstituted alkyl group containing 1–6 carbon atoms (preferably 1 carbon atom) or an ethoxylated hydroxy group containing 1–10 ethylene oxide units, wherein the ethoxylated hydroxy group has the formula:

$$HC—(OC_2H_5)_{1-10}$$

and where $R^4$ is a substituted or unsubstituted alkylene group containing 1–6 carbon atoms (preferably 1 carbon atom). Particularly suitable betaines include: coconutacylamidopropyl dimethylbetaine; $C_{12-14}$acylamidopropylbetaine; "$C_8$acylamidohexyldiethylbetaine". Preferred betaines are the $C_{10-18}$acylamidopropyl (or ethyl) dimethyl (or diethyl) betaines. Most prefered is dodecylamidopropyldimethylbetaine.

An alkaline earth metal salt or acid can be added to the fire fighting and cooling composition to control viscosity or pH. They also may be sources for ionic exchange. The salts and acids useful in this invention include magnesium chloride, magnesium sulfate, magnesium citrate, calcium chloride, sodium chloride, sodium sulfate, sodium citrate, citric acids, and mixtures thereof. The salts or acids would be most useful at concentrations from about 0.01% to about 5% by weight.

The fire fighting and cooling composition herein described is to be mixed with water through standard fire fighting equipment and applied to hydrocarbon or polar solvent fires at a concentration of 0.01% to 12% by volume (e.g., 0.01–12% fire fighting and cooling composition and the remainder water); preferably 0.1% to 6% by volume. Lower volatile liquid hydrocarbons will only require application from the low end of the concentration range while higher volatile liquid hydrocarbons and polar solvents will require application from the high end of the concentration range (e.g., diesel fuel 0.2% by volume application; high octane unleaded gasoline 3% by volume application). A fire fighting and cooling composition having the following formula is most preferred:

(a) from about 2% to about 6% of a water soluble amine oxide having one alkyl group of from 8 to about 16 carbon atoms and 2 alkyl groups from 1 to about 3 carbon atoms;

(b) from 10% to about 30% magnesium alkyl sulfate having from about 12 to 16 carbon atoms in the alkyl group;

(c) from 0% to 30% of magnesium alkyl ether sulfate obtained from an alcohol having from about 12 to about 16 carbon atoms, ethoxylated with from about 1 to about 12 mole of ethylene oxide;

(d) from 0% to about 35% of ammonium, mono, di, or triethanolammonium alkyl ether sulfate obtained from an alcohol having from about 12 to about 16 carbon atoms, ethoxylated with from 1 to about 12 moles of ethylene oxide;

(e) from 0.01% to about 8% of a $C_{12-14}$acylamidopropyldimethylbetaine;

(f) from 0% to about 5% magnesium chloride, magnesium sulfate, magnesium citrate, calcium chloride, sodium chloride, sodium sulfate, sodium citrate, or citric acid or mixtures thereof; and (g) the balance consists of water or water/$C_1$–$C_5$ alkanol (preferably isopropanol) mixtures.

EXAMPLES

The following fire fighting and cooling compositions are formulated on a weight percent basis.

| | A | B | C | D | E | F |
|---|---|---|---|---|---|---|
| Sodium dodecylbenzene sulfonate | 34 | — | — | — | — | — |
| Magnesium dodecylbenzene sulfonate | — | 34 | — | — | — | — |
| Sodium lauryl sulfate | — | — | 34 | — | — | — |
| Magnesium lauryl sulfate | — | — | — | 10 | — | — |
| Ammonium lauryl ether sulfate | — | — | — | 24 | 20 | 34 |
| Magnesium lauryl ether sulfate | — | — | — | — | 14 | — |
| Dimethyldodecylamine oxide | 3 | 3 | 3 | 3 | 3 | 3 |
| $C_{12-14}$ acylamidopropyldimethylbetaine | 4 | 4 | 4 | 4 | 4 | 4 |
| citric acid | — | — | — | 2 | 3 | 2 |
| NaCl | — | — | — | 2 | 2 | 2 |
| water | 59 | 59 | 59 | 52 | 51 | 52 |
| Isopropanol | — | — | — | 3 | 3 | 3 |

Formulations were evaluated by comparing their extinguishment and sealing characteristics when applied at 3% in water, through a pressurized water fire extinguisher, to a 1.6 $m^2$ pan containing about 2 to 3 L JP-4 aviation turbine fuel. JP-4 was chosen as it has a low flash point, volatile hydrocarbon content similar to gasoline, and an aromatic hydrocarbon content, of benzene and benzene analogs, of from about 23% to 27%. Volume of fluid applied was constant for each test. Formulas A, B, and C showed acceptable knockdown and extinguishment of the test fire. The foam blankets of A, B, and C were thin and would not inhibit rekindle of the test fire. Formulas D, E, and F showed superior knockdown and extinguishment, and also provided a thick foam blanket that inhibits rekindle. Formula F was tested at a large fire training facility. 200 liters of methanol were placed in a 24 $m^2$ pan after 1.5 min preburn the fire was extinguished in 55 sec., using 2 nozzles flowing 308 l/min each. The foam blanket successfully inhibited rekindle (application of a torch to the surface) with a 0.93% concentration of the F formula; similar application of a 0.67% concentration on 400 liters methanol produced good extinguishment but rekindle was not inhibited. This was a test to determine the low end of the concentration range for application to polar solvent fires, methanol in particular. At the same facility, a test was completed to simulate a vertical gasoline storage tank afire at the top. After a substantial preburn the F formula extinguished the fire in 53 sec. at a concentration of 0.28%. The standard product used to combat this fire, containing fluorocarbon surfactants, required 1 min. 35 sec at a concentration of 3%.

While the above-discussion focusses on the unique ability of the composition to put out a hydrocarbon or solvent fire, it should be understood that the composition also has cooling properties and can also be used as a retardant/protectant. The foam composition is formulated such that large quantities of water are able to adhere to the surface of three dimensional objects such as houses, buildings, ships, airplanes, trees, etc. This is because the composition allows for the creation of a stable foam that includes large quantities of water. Hence, cooling can be achieved quickly by spraying the foam on a heated object (e.g., coal, metal, etc.), and the composition can be used in protectant/retardant applications by spraying the foam on the object to be protected.

While the invention has been described in terms of its preferred embodiments, those skilled in the art will recognize that the invention can be practiced with modification within the spirit and scope of the appended claims.

I claim:

1. A fire fighting and cooling composition, comprising:

at least one non-ionic surfactant selected from the group consisting of amine oxides, phosphine oxides, and sulfoxides, said non-ionic surfactant being semi-polar in character and having a substituted or unsubstituted alkyl side chain having greater than 8 carbon atoms;

at least one anionic surfactant selected from the group consisting of ammonium salts of organic sulfates, said ammonium salts of organic sulfates being the only anionic surfactants in said fire fighting and cooling composition, said anionic surfactant being selected from the group consisting of:

alkyl sulfates having the formula $(ROSO_3)M$ where R is a substituted or unsubstituted alkyl group having 8–28 carbon atoms and M is either ammonium or substituted ammonium; and alkyl ether sulfates having the formula $RO(C_2H_4O)_\omega SO_3M$ where R is a substituted or unsubstituted alkyl group having 8–28 carbon atoms, ω ranges from 1–30, and M is ammonium or substituted ammonium;

an amphoteric surfactant having the formula:

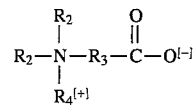

wherein $R_{1-4}$ are selected from the group consisting of substituted and unsubstituted alkyl constituents, substituted and unsubstituted cycloalkyl constituents, substituted and unsubstituted aryl constituents, and ethoxylated hydroxy groups containing 1–10 ethylene oxide units, and may be the same or different, wherein said non-ionic surfactant is present at concentrations ranging from 0.25% to 10% by weight, said anionic ammonium salt surfactant is present at concentrations ranging from 20% to 50% by weight, and said amphoteric surfactant is present at concentrations ranging from 0.25% to 15% by weight, with a remainder of said fire fighting and cooling composition being an aqueous fluid.

2. The fire fighting and cooling composition of claim 1 wherein said anionic ammonium salt surfactant is an alkyl sulfate having the formula $ROSO_3M$ where R is a substituted or unsubstituted alkyl group having 8–28 carbon atoms and M is ammonium or substituted ammonium.

3. The fire fighting and cooling composition of claim 1 wherein said anionic ammonium salt surfactant is an alkyl ether sulfate having the formula $(RO(C_2H_4O)_\omega SO_3)_2M$ where R is a substituted or unsubstituted alkyl group having 8–28 carbon atoms, ω ranges from 1–30, and M is ammonium or substituted ammonium.

4. The fire fighting and cooling composition of claim 1 wherein said anionic ammonium salt surfactant is present at concentrations ranging from 24% to 50% by weight.

5. The fire fighting and cooling composition of claim 1 wherein said anionic ammonium salt surfactant is present at concentrations ranging from 34% to 50% by weight.

6. The fire fighting and cooling composition of claim 1 wherein said amphoteric surfactant is selected from the group consisting of coconutacylamidopropylbetaine, dimethylbetaine, $C_{12-14}$acylamidopropylbetaine, and $C_8$acylamidohexyldiethylbetaine.

7. The fire fighting and cooling composition of claim 1 further comprising at least one salt selected from the group consisting of magnesium chloride, magnesium sulfate, calcium chloride, and sodium chloride, wherein said at least one salt is present in concentrations ranging from 0.01% to 5% by weight.

8. The fire fighting and cooling composition of claim 1 wherein said amphoteric surfactant is present at concentrations ranging from 1% to 10% by weight.

9. The fire fighting and cooling composition of claim 1 wherein said non-ionic surfactant is an amine oxide that is water soluble and said substituted or unsubstituted alkyl side chain is 8–28 carbons in length.

10. The fire fighting and cooling composition of claim 9 wherein said amine oxide further comprises two substituted or unsubstituted alkyl moieties one to three carbon atoms in length.

11. The fire fighting and cooling composition of claim 9 wherein said substituted or unsubstituted alkyl side chain is linear and unconjugated.

12. The fire fighting and cooling composition of claim 1 wherein said amphoteric surfactant is an acylamidoalkylbetaine.

13. The fire fighting and cooling composition of claim 12 wherein said acylamidoalkylbetaine has the following formula:

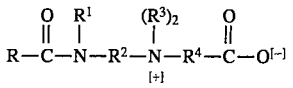

wherein R is a substituted or unsubstituted alkyl or alkylaryl group having 6–28 carbon atoms, $R^1$ is a hydrogen or substituted or unsubstituted alkyl group having 1–6 carbon atoms, $R^2$ is a substituted or unsubstituted alkylene group having 1–10 carbon atoms, $R^3$ is a substituted or unsubstituted alkyl group containing 1–6 carbon atoms or an ethoxylated hydroxy group containing 1–10 ethylene oxide units, and $R^4$ is a substituted or unsubstituted alkylene group containing 1–6 carbon atoms.

14. The fire fighting and cooling composition of claim 13 wherein said acylamidoalkylbetaine is dodecylamidopropyldimethylbetaine.

15. The fire fighting and cooling composition of claim 1 further comprising at least one salt or acid selected from the group consisting of magnesium chloride, magnesium citrate, magnesium sulfate, calcium chloride, sodium citrate, sodium chloride, and citric acid.

16. The fire fighting and cooling composition of claim 15 wherein said at least one salt or acid is present in concentrations ranging from 0.01% to 5% by weight.

17. The fire fighting and cooling composition of claim 1 further comprising a mixture of water and $C_{1-5}$ alkanols.

18. The fire fighting and cooling composition of claim 17 wherein said $C_{1-5}$ alkanol is isopropanol.

19. A foam-forming composition for fire fighting and cooling, comprising:

(a) water; and (b) a surfactant mixture contained in said composition in concentrations ranging from 0.01% to 12% by volume, said surfactant mixture comprising:

(i) at least one non-ionic surfactant selected from the group consisting of amine oxides, phosphine oxides, and sulfoxides, said non-ionic surfactant being semipolar in character and having a substituted or unsubstituted alkyl side chain having greater than 8 carbon atoms;

(ii) at least one anionic surfactant selected from the group consisting of ammonium salts of organic sulfates, said ammonium salts of organic sulfates being the only anionic surfactants in said fire fighting and cooling composition, said anionic surfactant being selected from the group consisting of:

alkyl sulfates having the formula $(ROSO_3)M$ where R is a substituted or unsubstituted alkyl group having 8–28 carbon atoms and M is either ammonium or substituted ammonium; and alkyl ether sulfates having the formula $RO(C_2H_4O)_\omega SO_3M$ where R is a substituted or unsubstituted alkyl group having 8–28 carbon atoms, ω ranges from 1–30, and M is ammonium or substituted ammonium;

(iii) an amphoteric surfactant having the formula:

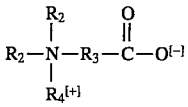

wherein $R_{1-4}$ are selected from the group consisting of substituted and unsubstituted alkyl constituents, substituted and unsubstituted cycloalkyl constituents, substituted and unsubstituted aryl constituents, and ethoxylated hydroxy groups containing 1–10 ethylene oxide units, and may be the same or different, and wherein said non-ionic surfactant is contained at concentrations ranging from 0.25% to 10% by weight of said surfactant mixture, said anionic ammonium salt surfactant is contained at concentrations ranging from 20% to 50% by weight of said surfactant mixture, and said amphoteric surfactant is contained at concentrations ranging from 0.25% to 15% by weight of said surfactant mixture.

20. The foam-forming composition of claim 19 wherein said surfactant mixture is contained in said composition in concentrations ranging from 0.1% to 6% by volume.

* * * * *